US006821159B2

(12) United States Patent
Munger, Jr. et al.

(10) Patent No.: US 6,821,159 B2
(45) Date of Patent: Nov. 23, 2004

(54) CUSTOMIZABLE CONNECTOR KEYING SYSTEM

(75) Inventors: Robert E. Munger, Jr., Tucson, AZ (US); Bryan W. Cindrich, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 10/293,534

(22) Filed: Nov. 12, 2002

(65) Prior Publication Data

US 2004/0092172 A1 May 13, 2004

(51) Int. Cl.[7] ..... H01R 13/64
(52) U.S. Cl. ..... 439/680; 439/681
(58) Field of Search ..... 439/680, 681

(56) References Cited

U.S. PATENT DOCUMENTS 3,714,617 A * 1/1973 Bright et al. ..... 439/681
3,778,749 A * 12/1973 Kapell ..... 439/411
3,950,059 A * 4/1976 Anhalt et al. ..... 439/261
4,140,357 A * 2/1979 Wolz et al. ..... 439/31
4,929,184 A * 5/1990 Emadi et al. ..... 439/681
4,931,021 A * 6/1990 Mohan ..... 439/285
5,267,866 A * 12/1993 Swift et al. ..... 439/31
5,778,121 A * 7/1998 Hyzin ..... 385/55
6,540,549 B2 * 4/2003 Rupert ..... 439/502

* cited by examiner

*Primary Examiner*—Chandrika Prasad
(74) *Attorney, Agent, or Firm*—Thomas J. Finn; Leonard A. Alkov; Karl A. Vick

(57) ABSTRACT

A modifiable connector keying system (16). The keying system (16) includes a first shaped feature (30, 32) that is removably connected to a first connector component. A second shaped feature (36, 38) is removably connected to a second connector component. The first shaped feature (30, 32) and the second shaped feature (36, 38) are shaped so that the first shaped feature (30, 32) fits with the second shaped feature (36, 38) to selectively allow the first connector component to connect with the second connector component. In a more specific embodiment, the keying system (16) further includes a first mechanism (34, 40, 44) for removably connecting the first shaped feature (30, 32) to the first connector component and the second shaped feature (36, 38) to the second connector component. A second mechanism (30, 34, 44) enables selective adjustment of the first shaped feature (30, 32) and the second shaped feature (36, 38) to customize the keying system (16).

22 Claims, 4 Drawing Sheets

CUSTOMIZABLE CONNECTOR KEYING SYSTEM

RIGHTS IN INVENTION

This invention was made with support under Government Subcontract No. 100200 Boeing Corp. under Prime Contract HQ0006-01-C-0001 with the Department of the Army. The U.S. Government may have certain rights to this invention.

BACKGROUND OF THE INVENTION

1. Field of Invention

This invention relates to electrical connectors. Specifically, the present invention relates to systems and methods for keying connectors to prevent erroneous connections.

2. Description of the Related Art

Connector keying systems are employed in various demanding applications including connectors for electronic test equipment, computers, life support machines, and etc. Such keying systems must reliably prevent inadvertent electrical connections.

Keying systems are particularly important in interfacing applications involving electronic test equipment, where interface cables must be properly connected to prevent costly hardware or software damage. Typically, different connector types are used to interface hardware components. For example, one interface cable may be fitted with a 9-pin micro-D style connector, while another interface cable may be fitted with a 160-pin micro-D style connector.

Some applications require plural interface cables having similar connector pin arrangements. In these applications, the connectors are often labeled (by color or part number) to facilitate proper connections. However, connector labeling is undesirably susceptible to human error.

Alternatively, similar connectors are permanently modified via a special keying system to prevent inadvertent interfacing of incompatibles hardware components. Conventional keying systems are typically built into the connector and are not readily customizable without extensive modification of the connector. The systems may include various pins that are selectively arranged on flanges of the male and female connector components. Connection between the male and female connector components is only allowed when the pin arrangements match up for proper connector mating.

Conventionally, male and female connector pairs are permanently keyed in a particular configuration and sold together. Consequently, to use the keying system, pre-existing interface cable arrangements require costly rework or are typically replaced with new cable fitted with accompanying keyed connectors. Unfortunately, cable and connector replacement is often time-consuming and costly, especially in applications having cables that run through walls or floors. Cable and connector replacement is particularly problematic in applications having connector components that are permanently installed on circuit boards. Removal of the circuit boards for permanent connector replacement or modification is often impractical.

Alternatively, existing connectors are permanently modified to accommodate the keying system. Connector machining is often required to modify the connectors to accommodate the keying system or to change the current keying configuration, which is undesirably costly and causes system downtime. Consequently, conventional keying systems are often limited to certain applications.

Hence, a need exists in the art for a versatile, removable, and customizable connector keying system that does not require permanent connector modification and is easily programmable to accommodate several keying configurations and various connector types.

SUMMARY OF THE INVENTION

The need in the art is addressed by the connector keying system of the present invention. In the illustrative embodiment, the inventive keying system is adapted for use with connectors having flanges. The keying system includes a first shaped feature that is removably connected to a first connector component. A second shaped feature is removably connected to a second connector component. The first shaped feature and the second shaped feature are shaped so that the first shaped feature fits with the second shaped feature to selectively allow the first connector component to connect with the second connector component.

In a specific embodiment, the keying system further includes a first mechanism for removably connecting the first shaped feature to the first connector component and the second shaped feature to the second connector component. A second mechanism enables selective orientation of the first shaped feature and the second shaped feature to customize the keying system.

The first mechanism includes a first retainer body and a second retainer body for facilitating attachment of the first shaped feature to the first connector component and the second shaped feature to the second connector component, respectively. The second mechanism includes a first feature assembly for accommodating the first shaped feature. The first feature assembly is selectively rotatable relative to the first retainer body to selectively cause a different orientation of the first shaped feature. A second feature assembly is selectively rotatable relative to the second retainer body to selectively cause a different orientation of the second shaped feature.

In a more specific embodiment, the first feature assembly and the second feature assembly are pin assemblies. The first shaped feature and the second shaped feature comprise a first pin and hole arrangement and a second pin and hole arrangement, respectively. The first pin and hole arrangement is configured relative to the second pin and hole arrangement to allow only the first connector and the second connector, having the first pin and hole arrangement and the second pin and hole arrangement mounted thereon, respectively, to interconnect.

The first and second pin assemblies have first and second corresponding pin assembly bases with predetermined numbers of pins mounted on front surfaces thereof. The first and second pin assemblies have first and second corresponding shafts therethrough extending from rear surfaces of the first and second pin assembly bases, respectively. The first and second retainer bodies have openings therein for receiving the first and second shafts of the first and second pin assemblies.

The first mechanism includes first and second retaining rings for retaining first and second connector flanges of the first and second connectors, respectively, between the first retaining ring and the first retainer body and between the second retaining ring and the second retainer body. The first and second retaining rings are attachable to the first and second shafts, respectively.

The first and second shafts are completely hollow with an internal thread that extends part way through the shaft. The first connector component includes a jackscrew that extends through the first connector component and through the first and second holes to secure the first connector component to the second connector component and to secure the mating connectors. The first and second retainer bodies have ridges for mating with the pin assembly bases to secure the pin assembly bases relative to the retainer bodies to prevent rotation of the pin assembly bases relative to the retainer bodies when the keying systems are installed on the first and the second connector components. The first and second retainer bodies have another opposing ridge that prevents rotation of the retainer body relative to the connector body as well.

The novel design of the present invention is facilitated by the pin assemblies, which may be rotated relative to associated retainer bodies that hold the pin assemblies to corresponding connector flanges. Use of the retainer body and associated retaining ring allow the keying pin assemblies to be connected to or removed from connector flanges without permanently modifying the connectors. The ability to rotate the pin assemblies relative to the retainer bodies by simply removing the retaining clip and manually rotating the pin assemblies enables different keying configurations. Hence, the keying system of the present invention is easily adaptable to various existing connectors; does not require permanent connector modification or machining; and is easily customizable for plural keying configurations.

DESCRIPTION OF THE INVENTION

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
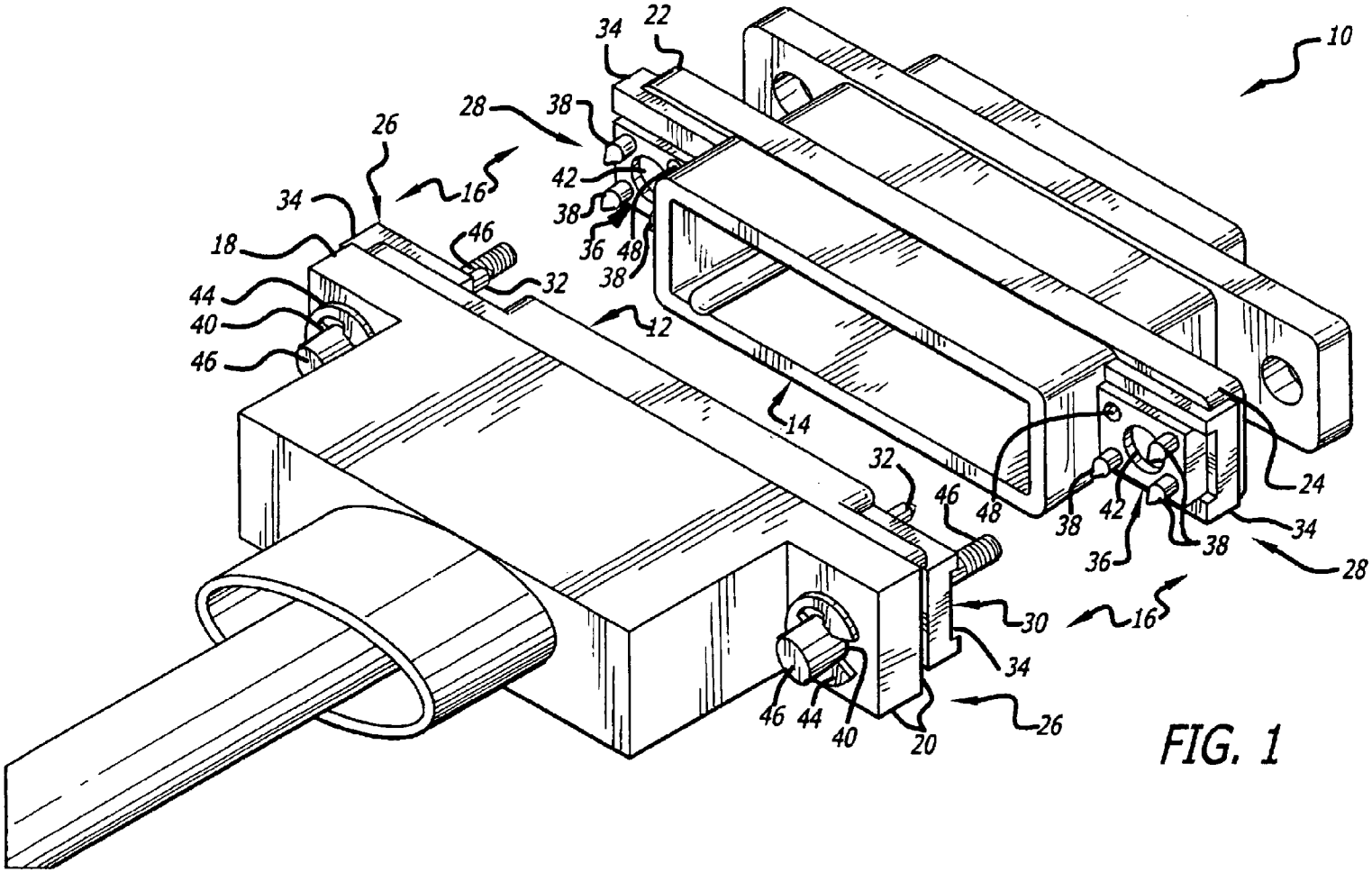
FIG. 1 is a diagram of an exemplary micro-D style connector having male and female components fitted with a connector keying system constructed in accordance with the teachings of the present invention.

FIG. 1 is a diagram of an exemplary micro-D style connector 10 having a male component 12 and a female component 14 fitted with a connector keying system 16 constructed in accordance with an illustrative embodiment of the teachings of the present invention. The male connector component 12 has a left male flange 18 and a right male flange 20 that are positioned on opposite sides of the male connector component 12 and have surfaces that face toward a corresponding left female flange 22 and a right female flange 24, respectively. The left and right female flanges 22, 24 are positioned on opposite sides of the female connector component 14.

The left and right male flanges 18, 20 are each fitted with a male keying portion 26 of the connector keying system 16. The left and right female flanges 22, 24 are fitted with a female keying portion 28. In the present specific embodiment, the male keying portion 26 includes a male pin assembly 30, which accommodates a single pin 32 that faces the female connector component 14. The female keying portion 28 includes a female pin assembly 36 that accommodates three pins 38.

Each pin assembly 30, 36 is stabilized by a separate retainer body 34 that fits between the male pin assembly 30 and the male flange 20 and between the female pin assembly 36 and the female flange 24. Each retainer body 34 has a central hole and four additional holes, as discussed more fully below. The four additional holes correspond to possible pin positions.

The pin assemblies 30, 36 each have a hollow shaft 40 with partial internal threads that extends from rear surfaces of each pin assembly 30, 36. A center hole 42 through the center of each pin assembly 30, 36 is aligned with the interior of each hollow shaft 40. Each hollow shaft 40 has partial internal threads (not shown). Each shaft 40 extends through corresponding connector flanges 20, 24, via pre-existing jackset screw holes in the flanges 20, 24, and accommodates a retaining ring 44 on the backside of each flange 20, 24. The retaining ring 44 secures corresponding keying portions 26, 28 to the flanges 20, 24.

The center hole 42 through each pin assembly 30, 36 accommodates a captive jackset screw 46 that passes through each hollow shaft 40. Captive jackset screws, such as the jackset screw 46, are known in the art and help hold the male connector component 12 to the female connector component 14. Each central shaft or hole 40, 42 of the male keying portion 26 and the female keying portion 28, respectively, may be threaded to help accommodate each jackset screw 46. Those skilled in the art will appreciate that the keying system 16 may be adapted for use with connector fastening mechanisms other than jackset screws without departing from the scope of the present invention.

The male pin assembly 30 has three empty pin holes in positions corresponding to the three pins 38 of the female pin assembly 36, as discussed more fully below. The female pin assembly 36 has an empty pin hole 48 in a position corresponding to the single pin 32 on the male pin assembly 30. The single pin 32 and the three pins 38 are oriented so that when the male and female connector components 12, 24 are connected, the male and female keying portions 26, 28 mate, and the single pin 32 slides into the corresponding pin hole on the female pin assembly 36. Simultaneously, the three pins 38 slide into corresponding holes in the male pin assembly 30, as discussed more fully below.

When the male and female keying portions 26, 28 mismatch, such that the single pin 32 does not line up with the corresponding empty pin hole 48 in the female keying portion 28, the male and female connector components 12, 14 are prevented from connecting by the pins 32, 38.

The keying system 16 may be reconfigured by simply changing the orientation of the pins 32, 38 on the male and female keying portions 26, 28. The orientation of the pins 32, 38 may be changed for example, by removing the retaining clip 44 to release the male pin assembly 30 from the retainer body 34; rotating the male pin assembly 30 by a quarter turn; repositioning the male pin assembly 30 with the retainer body 34; and then reinstalling the retainer clip 44.

Those skilled in the art will appreciate that the pin assemblies 30, 36 may be replaced with other shaped features without departing from the scope of the present invention. For example, the pins 32, 38 may be replaced with bumps or other strategically shaped contours. Additional or fewer pins may also be employed.

Figure 2:
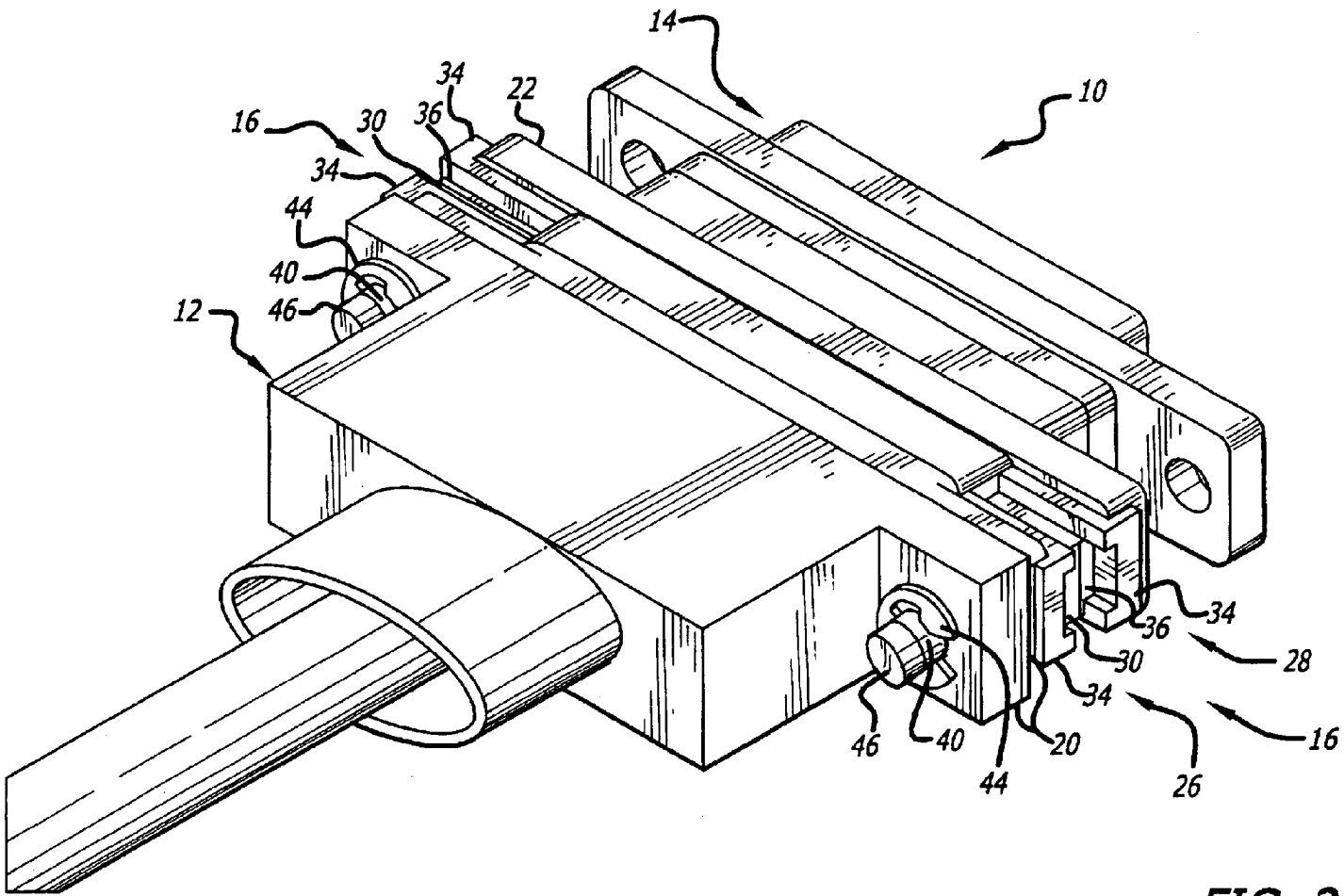
FIG. 2 is a diagram showing the micro-D style connector of FIG. 1 with the male and female components connected.

FIG. 2 is a diagram showing the micro-D style connector 10 of FIG. 1 with the male and female components 12, 14 connected. The male keying portion 26 and the female keying portion 28 are mated, and the corresponding pin assemblies 34, 36 are held tightly together via the retaining rings 44 and jackset screws 46.

The dimensions of the connector keying system 16 are sufficiently small to enable a complete electrical connection between the male connector component 12 and the female connector component 14. The male keying portion 26 and the female keying portion 28 may cause a larger separation between the connector components 12, 14 than would otherwise exist. However, this separation remains within acceptable connection tolerances.

Figure 3:
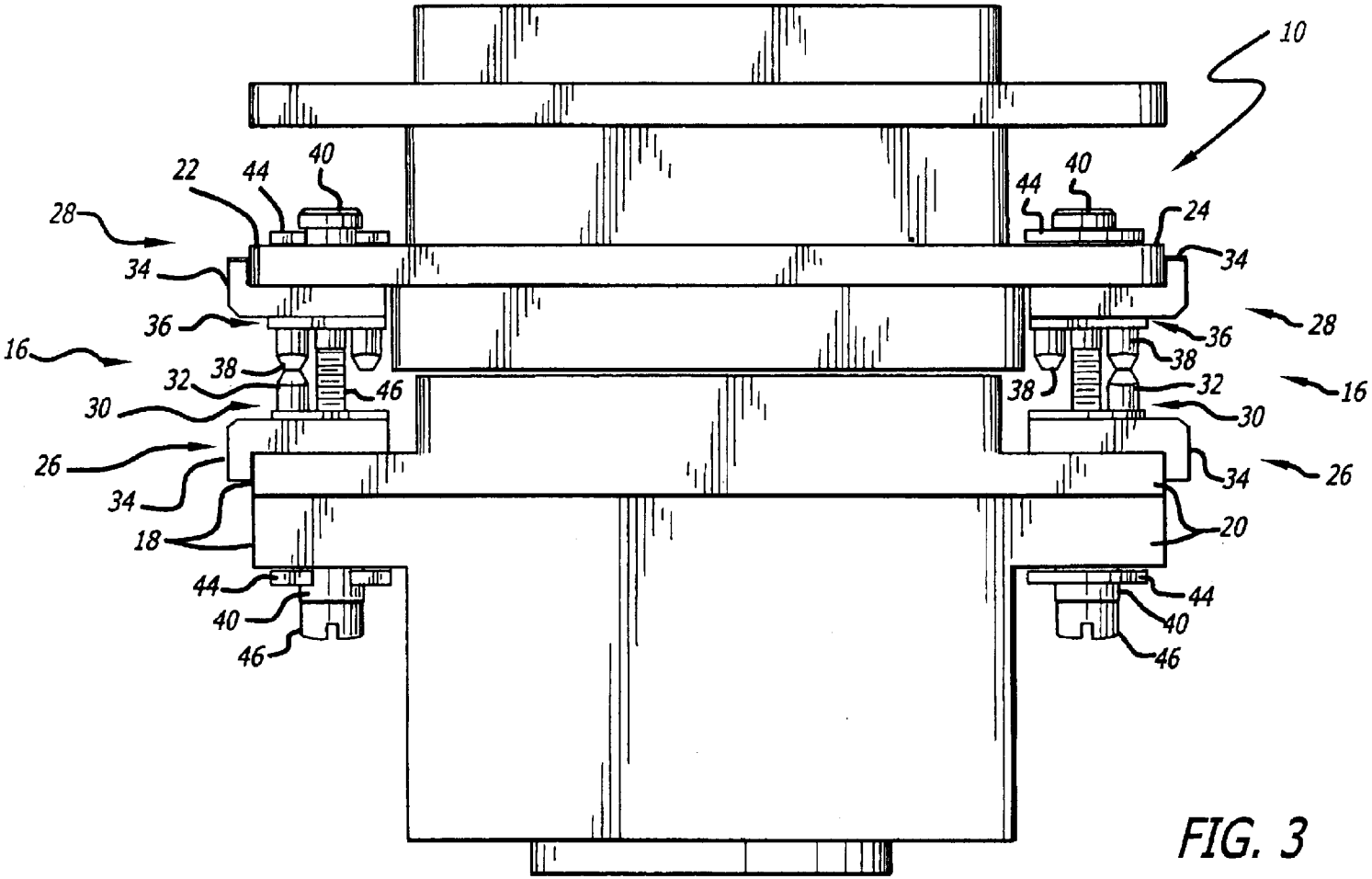
FIG. 3 is a diagram showing the micro-D style connector of FIG. 1 with the male and female components separated by the keying system due to a mismatch.

FIG. 3 is a diagram showing the micro-D style 10 connector of FIG. 1 with the male and female components 12, 14 separated by the keying system 16 due to a mismatch. The single pin 32 on the male pin assembly 30 of the male keying portion 26 is aligned relative to the pins 38 on the female pin assembly 36 of the female keying portion 28 so that the single pin 32 contacts one of the pins 38 on female pin assembly 36, thereby preventing the male keying portion 26 from mating with the female keying portion 28. This prevents the male connector component 12 from connecting with the female connector component 14. The lengths of the pins 32, 38 are set so that even a partial electrical connection between the male connector component 12 and the female connector component 14 is prevented. In the present specific embodiment, when the male keying portion 26 is mismatched with the female keying portion 28, a 0.030 inch gap exists between the connector components 12, 14.

Figure 4:
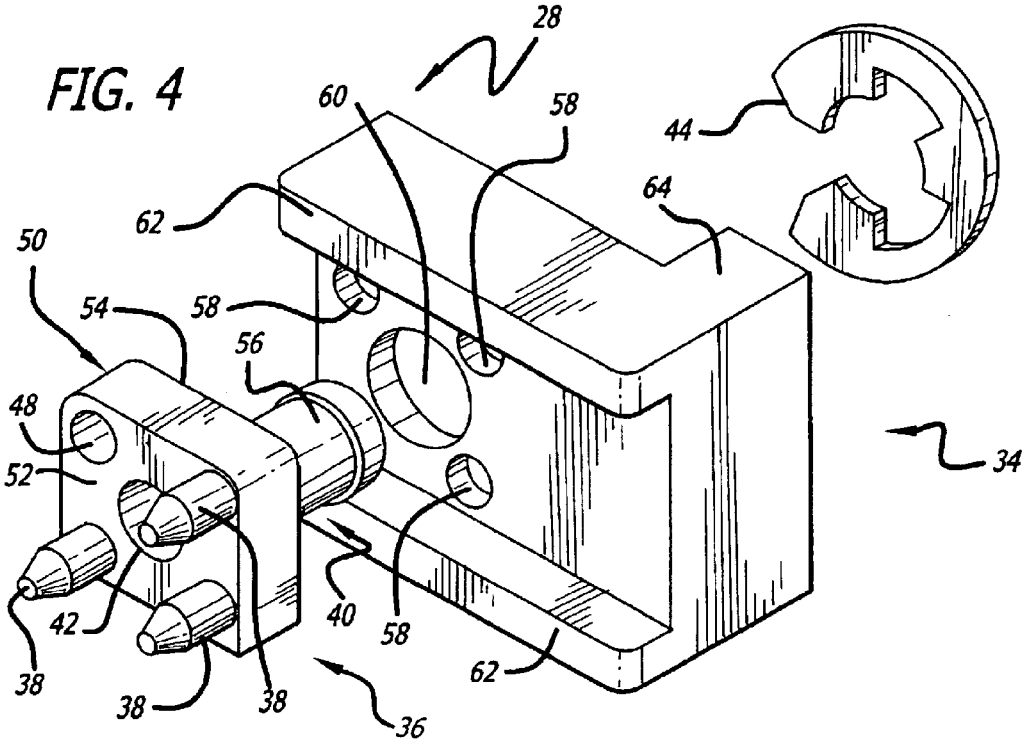
FIG. 4 is a more detailed diagram showing and exploded view of the female portion of the connector keying system of FIG. 1.

FIG. 4 is a more detailed diagram showing an exploded view of the female portion 28 of the connector keying system 16 of FIG. 1. The pin assembly 36 has a pin assembly base 50 with the center hole 42 extending perpendicularly through from a front surface 52 of the pin assembly base 50 and through the hollow shaft 40. The hollow shaft 40 extends from a rear surface 54 of the pin assembly base 50. The hollow shaft 40 has a retaining groove 56 therein that facilitates fastening of the retaining ring 44 to the hollow shaft 40.

The pin assembly base 50 also includes the empty pin hole 48, which is placed near a corner of the block-shaped pin assembly base 50. In the present specific embodiment, the three pins 38 extend from three different corners of the square-shaped front surface 52 of the pin assembly base 50. The fourth corner accommodates the empty pin hole 48. The empty pin hole 48 will accommodate the single pin 32 of FIG. 1 that extends from the male pin assembly 30 when the male pin assembly 30 mates with another matching pin assembly, such as the female pin assembly 36.

Those skilled in the art will appreciate that the pin assembly base 50 may be another shape, such as hexagonal, and that a different number of pins may be employed and distributed in various different positions about the pin assembly base 50. Furthermore, the exact shape of the pins 38 is application-specific and may be adjusted by one skilled in the art to meet the needs of a given application. In addition, the pins 38 may be replaced with any strategically shaped feature to meet the needs of a given application without departing from the scope of the present invention. For example, the front surface 52 of the pin assembly base 50 may be strategically contoured to provide a desired number of user-configurable keying combinations.

Depending on the interfacing environment, certain applications may require that a given keyed pin assembly be able to mate with more than one corresponding pin assembly. In this case, for example, one of the pins 38 may be removed. The modified pin assembly will then mate with any similar pin assembly that has missing pins in locations corresponding to the locations of the pins 38. Consequently, in this case, more than one pin configuration could mate with the modified pin assembly. The pins 38 may be threaded and screwed into corresponding threaded holes on the pin assembly base 50 to enable removal, replacement, or repositioning of existing pins 38.

In the preferred embodiment, at least one pin of a complimentary pin assembly, such as the male pin assembly 30 of FIG. 1, will coincide with an empty pin hole, such as the pin hole 48, on the pin assembly base 50. The pin that coincides with the empty pin hole 48 helps to stabilize and interlock the pin assemblies 30, 36.

The retainer body 34 of the female keying portion 28 is designed to secure the female pin assembly 36 on a connector flange, such as the flange 24 of FIG. 1, and to facilitate plural keying configurations. The retainer body 34 includes four holes 58 positioned on the retainer body 34 in positions directly coinciding with the three pins 38 and the empty pin hole 48 of the pin assembly base 50. The retainer body 34 also includes a central hole 60 that is sized to accommodate the hollow shaft 40 of the female pin assembly 36.

The retainer body 34 includes side ridges 62 for holding the pin assembly base 50 in place when the pin assembly 36 is mated with the retainer body 34. The ridges 62 facilitate mating the retainer body 34 with the pin assembly base 50 to prevent rotation of the pin assembly base 50 relative to the retainer body 34.

A retainer body flange 64 extends perpendicularly from the retainer body 34 and toward the retaining ring 44. The retainer body flange 64 helps to stabilize the retainer body 34 on a connector flange, such as the connector flange 24 of FIG. 1. The connector flange 24 fits between the retaining ring 44 and the backside of the retainer body 34 when the female keying portion 28 is installed on the connector flange 24.

In operation, the shaft 40 of the female pin assembly 36 is inserted into the central hole 60 of the retainer body 34 and then through a corresponding hole (not shown) on the connector flange 24 of FIG. 1. The pin assembly base 50 fits between the supporting ridges 58 of the retainer body 34, which keep the pin assembly base 50 from rotating when the base 50 is secured to the retainer body 34 with the retaining ring 44. The connector flange 24 of FIG. 1 fits between the retainer body 34 and the retaining ring 44. The empty pin hole 48 is aligned with one of the corresponding corner holes 58 in the retainer body 34.

Figure 5:
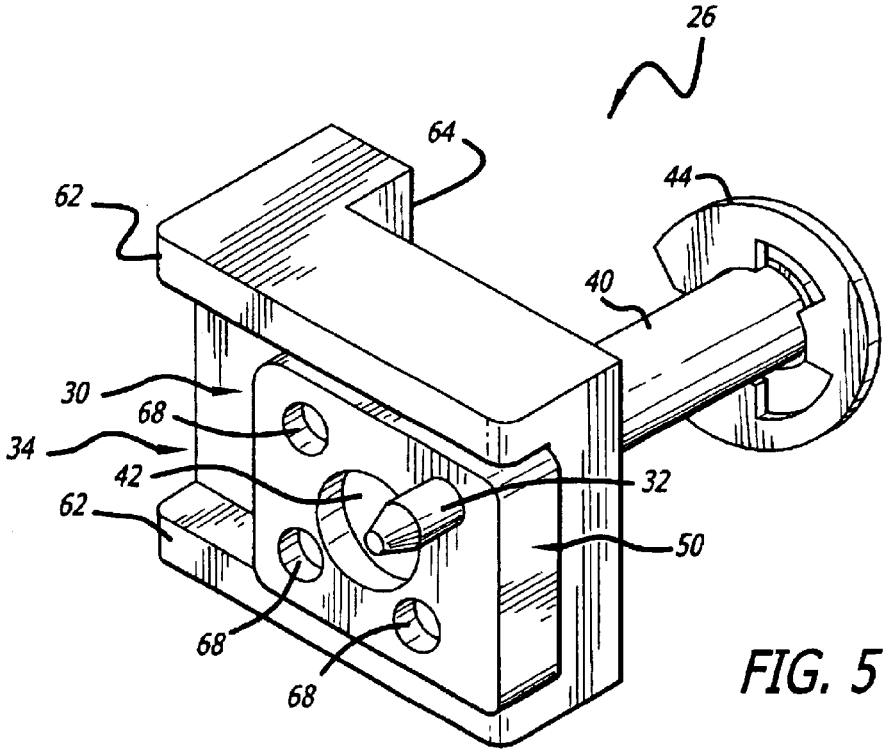
FIG. 5 is a diagram showing the male portion of the connector keying system of FIG. 1.

FIG. 5 is a diagram showing the male portion 26 of the connector keying system 16 of FIG. 1. With reference to FIGS. 4 and 5, when the single pin 32 of the matching male keying portion 26 coincides with the empty pin hole 48, the single pin 32 extends through the empty pin hole 48 and through a corresponding corner hole 58 of the retainer body 34. In addition, the three pins 38 extend through three corresponding empty pin holes 68 on the pin assembly base 36 of the male keying portion 26. This further secures keying portions 26 and 28, preventing any undesirable rotation of constituent components.

Those skilled in the art will appreciate that the three pins 38 may partially extend from the backside of the pin assembly base 50 and fit with the corner holes 58 of the retainer body 34. This may help further stabilize the retainer body 34 relative to the pin assembly 36.

When the female pin assembly 36 is fitted to the retainer body 34, a retaining groove 56 extends from the backside of the retainer body 34 and through a connector flange, such as the connector flange 24 of FIG. 1. The end of the connector flange abuts the retainer body flange 64. The retaining ring 44 fits with the retaining groove 56, thereby securing the female pin assembly 36, the retainer body 34, and the associated connector flange together. Those skilled in the art will appreciate that the retaining ring 44 may be replaced with another retaining mechanism, such as a nut, without departing from the scope of the present invention.

The female keying portion 28 may be reconfigured by simply removing the retaining ring 44; sliding the pin assembly 36 away from the retainer body 34 and accompanying ridges 62; rotating the pin assembly 36 by 90, 180, or 270 degrees; then reinserting the pin assembly 36 into the retainer body 34; and then reinstalling the retaining ring 44 via the retaining groove 56. The male keying portion 26 may be reconfigured similarly.

When the male pin assembly 30 matches the female pin assembly 36, the single pin 32 fits into the single hole 48, and the three empty holes 68 in the male pin assembly 30 accommodate the three pins 38 of the female pin assembly base 36. When the pins 32, 38 and holes 48, 68 are properly aligned, accompanying connector components will fit together to establish a connection, as shown in FIG. 2. If the male pin assembly 30 is mismatched with the female pin assembly 36, a connection between corresponding connector components will not be allowed, as shown in FIG. 3.

In the present specific embodiment, one of the keying portions 26, 28 will have three pins 38, while the other has as single pin 32. This enables sixteen different unique keying combinations. One particular orientation of the male pin assembly 30 will only match one corresponding orientation of the female pin assembly 36. Hence, no duplicate combinations, where one orientation of the female pin assembly 36 matches more than one orientation of the male pin assembly 30, are allowed in this embodiment.

Both pin assemblies 30, 36 are selectively rotatable relative to the retainer body 34 to enable different keying configurations. The retaining ring 44 is simply removed, and the pin assemblies 30, 36 are moved away from the retainer body 34 to facilitate rotation and reconfiguration. Use of the easily removable retaining ring 44 in combination with the pin assemblies 30, 36 and retainer body 34 facilitates both keying system reconfiguration and installation and removal from accompanying connector components.

Thus, the present invention has been described herein with reference to a particular embodiment for a particular application. Those having ordinary skill in the art and access to the present teachings will recognize additional modifications, applications, and embodiments within the scope thereof. It is therefore intended by the appended claims to cover any and all such applications, modifications and embodiments within the scope of the present invention.

Accordingly;

What is claimed is:

1. A cable connector keying system comprising:

a first shaped feature connected to a first connector component;

a second shaped feature connected to a second connector component; and means for removably connecting said first shaped feature to said first connector component and said second shaped feature to said second connector component respectively, said first shaped feature and said second shaped feature shaped so that said first connector component is connectable with said second connector component when said first shaped feature fits with said second shaped feature, said first shaped feature and said second shaped feature including a first pin arrangement and a second pin arrangement respectively.

2. The connector keying system of claim 1 further including second means for enabling selective adjustment of said first shaped feature and said second shaped feature to customize said keying system.

3. The connector keying system of claim 2 wherein said first means includes a first retainer body and a second retainer body for facilitating attachment of said first shaped feature to said first connector component and said second shaped feature to said second connector component.

4. The connector keying system of claim 3 wherein said second means includes a first assembly for accommodating said first shaped feature, said first assembly selectively rotatable relative, to said first retainer body to selectively cause a different orientation of said first shaped feature, and wherein said second means includes a second assembly selectively rotatable relative to said second retainer body to selectively cause a different orientation of said second shaped feature.

5. The connector keying system of claim 4 wherein said first assembly and said second assembly are pin assemblies.

6. The connector keying system of claim 5 wherein said first pin arrangement is arranged relative to said second pin arrangement to allow only said first connector component and said second connector component having said first pin arrangement and said second pin arrangement mounted thereon, respectively, to interconnect.

7. The connector keying system of claim 5 wherein said first and second pin assemblies have first and second corresponding pin assembly bases with predetermined numbers of pins mounted on front surfaces thereof.

8. The connector keying system of claim 7 wherein said first and second pin assemblies have first and second corresponding shafts therethrough extending from rear surfaces of said first and second pin assembly bases, respectively.

9. The connector keying system of claim 8 wherein said first and second retainer bodies have openings therein for receiving said first and second shafts of said first and second pin assemblies.

10. The connector keying system of claim 9 wherein said first means includes first and second retaining rings for retaining first and second connector flanges of said first and second connector components between said first retaining ring and said first retainer body and between said second retaining ring and said second retainer body, respectively.

11. The connector keying system of claim 10 wherein said first and second shafts are hollow and partially threaded, accommodating first and second holes, respectively, that run through said first and second pin assembly bases and through said first and second corresponding shafts, respectively.

12. The connector keying system of claim 11 wherein said first connector component includes a jackscrew that extends through said first connector component and through said first and second holes to secure said first connector component to said second connector component and to hold said keying assemblies in place.

13. The connector keying system of claim 12 wherein said first and second retainer bodies have ridges for mating with said pin assembly bases to secure said pin assembly bases relative to said retainer bodies to prevent rotation of said pin assembly bases relative to said retainer bodies when said keying systems are installed on said first and said second connector components.

14. A cable connector keying system comprising:

a first keying assembly having a first set of one or more pins in a first user-configurable configuration, said first keying assembly removably mountable to a first connector and a second keying assembly having a second set of one or more pins in a second user-configurable configuration and removably mountable to a second connector, said first configuration and said second configuration arrangeable so that said first configuration selectively matches said second configuration to enable said first connector to selectively connect to said second connector.

15. The connector keying system of claim 14 wherein said first configuration only matches said second configuration to enable said first connector to only connect to said second connector.

16. The connector keying system of claim 14 wherein said first keying assembly and said second keying assembly have one or more holes therein or therethrough to accommodate pins of said second keying assembly and said first keying assembly, respectively, when said first keying assembly matches said second keying assembly.

17. A cable connector keying system comprising:

first means for connecting a first shaped feature to a first connector component and a second shaped feature to a second connector component, said first shaped feature and said second shaped feature shaped so that said first shaped feature fits with said second shaped feature to allow said first connector component to connect with said second connector component and second means for enabling selective adjustment of said first shaped feature and said second shaped feature to customize said keying system.

18. A method for enabling selective connection of cable connector components comprising:

connecting a first shaped feature to a first connector component and a second shaped feature to a second connector component, said first shaped feature and said second shaped feature shaped so that said first shaped feature fits with said second shaped feature to allow said first connector component to connect with said second connector component, said first shaped feature and said second shaped feature being pin assemblies and said first shaped feature and said second shaped feature including a first pin arrangement and a second pin arrangement respectively and enabling selective adjustment of said first shaped feature and said second shaped feature to facilitate re-keying.

19. A connector keying system for use with a first connector and a second connector, said system comprising:

a first shaped key;

a second shaped key, said second key being shaped and mounted to mate with said first shaped key in a selective orientation of said second key relative to said first key;

a first mechanism for removably securing said first key to said first connector; and a second mechanism for removably securing said second key to said second connector, whereby said first connector may be mated to said second connector when said second key is disposed in said selective orientation and said first connector is prevented from mating with said second connector when said second key is not disposed into said selective orientation.

20. The invention of claim 19 further including means for selectively reshaping said first shaped key.

21. The invention of claim 20 further including means for selectively reshaping said second shaped key.

22. The invention of claim 21 wherein said first and second shaped keys are pin assemblies.

* * * * *